US005495899A

United States Patent [19]

Pastusek et al.

[11] Patent Number: 5,495,899

[45] Date of Patent: Mar. 5, 1996

[54] REAMER WING WITH BALANCED CUTTING LOADS

[75] Inventors: Paul E. Pastusek, Salt Lake City; Steve R. Matson, West Valley City, both of Utah

[73] Assignee: Baker Hughes Incorporated, Houston, Tex.

[21] Appl. No.: 431,269

[22] Filed: Apr. 28, 1995

[51] Int. Cl.[6] ..... E21B 10/26; E21B 10/46; E21C 25/10

[52] U.S. Cl. ..... 175/57; 175/385; 175/431

[58] Field of Search ..... 175/431, 57, 65, 175/393–386, 391, 412, 413, 406; 299/88, 91

[56] References Cited

U.S. PATENT DOCUMENTS

| | | | |
|---|---|---|---|
| 4,119,350 | 10/1978 | Sander et al. | 175/394 X |
| 4,635,738 | 1/1987 | Schillinger et al. | 175/398 |
| 4,932,484 | 6/1990 | Warrren et al. | 175/385 |
| 5,009,271 | 4/1991 | Maric et al. | 175/53 |
| 5,042,596 | 8/1991 | Brett et al. | 175/57 |
| 5,052,503 | 10/1991 | Lof | 175/258 |
| 5,165,494 | 11/1992 | Barr | 175/376 |
| 5,199,511 | 4/1993 | Tibbitts et al. | 175/65 |
| 5,222,566 | 6/1993 | Taylor | 175/431 |
| 5,259,469 | 11/1993 | Stjernstrom et al. | 175/385 |

*Primary Examiner*—Stephen J. Novosad
*Attorney, Agent, or Firm*—Trask, Britt & Rossa

[57] ABSTRACT

A multi-bladed reaming apparatus for enlarging a subterranean borehole, the apparatus having a tubular body with a plurality of longitudinally-extending, circumferentially-spaced, generally radially-extending blades carrying cutting elements, the blades being unequally spaced about the body. The cutting depth of the cutting elements on at least one of the blades is adjusted to modify the distribution of the depth of cut (DOC) among the cutting elements to substantially equalize the volume of formation material removed by the blades. Wear is reduced and the potential for premature failure of cutting elements on any single blade is alleviated.

15 Claims, 2 Drawing Sheets

REAMER WING WITH BALANCED CUTTING LOADS

BACKGROUND OF THE INVENTION

1. Field of the Invention

The present invention relates generally to enlarging the diameter of a subterranean borehole, and more specifically to enlarging the borehole below a portion thereof which remains at a lesser diameter. The invention also is perceived to have general utility for drill bits.

2. State of the Art

It is known to employ both eccentric and bi-center bits to enlarge a borehole below a tight or undersized portion thereof.

An eccentric bit includes an extended or enlarged cutting portion which, when the bit is rotated about its axis, produces an enlarged borehole. An example of an eccentric bit is disclosed in U.S. Pat. No. 4,635,738.

A bi-center bit assembly employs two longitudinally-superimposed bit sections with laterally offset axes. The first axis is the center of the pass through diameter, that is, the diameter of the smallest borehole the bit will pass through. This axis may be referred to as the pass through axis. The second axis is the axis of the hole cut as the bit is rotated. This axis may be referred to as the drilling axis. There is usually a first, lower and smaller diameter pilot section employed to commence the drilling, and rotation of the bit is centered about the drilling axis as the second, upper and larger diameter main bit section engages the formation to enlarge the borehole, the rotational axis of the bit assembly rapidly transitioning from the pass through axis to the drilling axis when the full diameter, enlarged borehole is drilled.

Rather than employing a one-piece drilling structure ,.such as an eccentric bit or a bi-center bit to enlarge a borehole below a constricted or reduced-diameter segment, it is also known to employ an extended bottomhole assembly (extended bi-center assembly) with a pilot bit at the distal end thereof and a reatner assembly some distance above. This arrangement permits the use of any standard bit type, be it a rock bit or a drag bit, as the pilot bit, and the extended nature of the assembly permits greater flexibility when passing through tight spots in the borehole as well as the opportunity to effectively stabilize the pilot bit so that the pilot hole and the following reamer will traverse the path intended for the borehole. This aspect of an extended bottomhole assembly is particularly significant in directional drilling.

While all of the foregoing alternative approaches can be employed to enlarge a borehole below a reduced-diameter segment, the pilot bit with reamer assembly has proven to be the most effective overall. The assignee of the present invention has, to this end, designed as reaming structures so-called "reamer wings" in the very recent past, which reamer wings generally comprise a tubular body having a fishing neck with a threaded connection at the top thereof, and a tong die surface at the bottom thereof, also with a threaded connection. The upper mid-portion of the reamer wing includes one or more longitudinally-extending blades projecting generally radially outwardly from the tubular body, the outer edges of the blades carrying superabrasive (also termed superhard) cutting elements, commonly termed PDC'S (for Polycrystalline Diamond Compact). The lower mid-portion of the reamer wing may include a stabilizing pad having an arcuate exterior surface of the same or slightly smaller radius than the radius of the pilot hole on the exterior of the tubular body and longitudinally below the blades. The stabilizer pad is characteristically placed on the opposite side of the body with respect to the reamer blades so that the reamer wing will ride on the pad due to the resultant force vector generated by the cutting of the blade or blades as the enlarged borehole is cut. The aforementioned reamer wing as described and as depicted herein is not acknowledged or admitted to constitute prior art to the invention described and claimed herein.

While the above-described reamer wing design has enjoyed some success, the inventors herein have noted that cutting elements on the "leading" primary blade which contacts the formation suffer undue wear and in some instances damage in comparison to the other, following blades. This recognition and an appreciation of the phenomena leading to the aforementioned wear and damage have resulted in the present invention, which preserves and enhances the advantages of a state-of-the-art reamer wing while offering a more robust product to the industry.

SUMMARY OF THE INVENTION

The present invention comprises a reamer wing comprising a tubular body with at least two longitudinally-extending, unequally circumferentially-spaced blades carrying cutting elements thereon. The cutting elements are located in fight of the blade spacing for a given rate of penetration (ROP) and rotational speed of the reamer wing to provide a substantially equal workload between the cutting elements on all of the blades by adjusting the cutting depth of the cutting elements on one blade relative to that of the cutting elements on another blade.

More specifically, given ROP and rotational speed, the cutting elements on the leading blade of a blade series are adjusted upwardly or inwardly relative to the blade profile. Cutting element location may be adjusted as necessary or deskable on other blades as well, since three, four and even five-blade reamer wings are employed, the latter for particularly large boreholes. The adjustment is effected in most instances to substantially equalize the volume of formation material removed by cutting elements on each of the blades.

The invention also contemplates application to bit design in general, and particularly to multiple-bladed bits wherein the blades are not evenly circumferentially spaced. Such bits are quite common in practice, and notably include the recently-developed so-called "anti-whir" bits, wherein blades and cutting elements are placed to develop a directed lateral force vector and a cutting element-devoid bearing structure, typically a pad, is located on the gage in the area of the resultant lateral force vector.

The invention reduces the inequality in cutting element wear between a series of blades and the tendency of the leading blade and cuffing elements thereon in a blade series to sustain proportionally greater damage during drilling.

DETAILED DESCRIPTION OF THE PREFERRED EMBODIMENT

Figure 1:
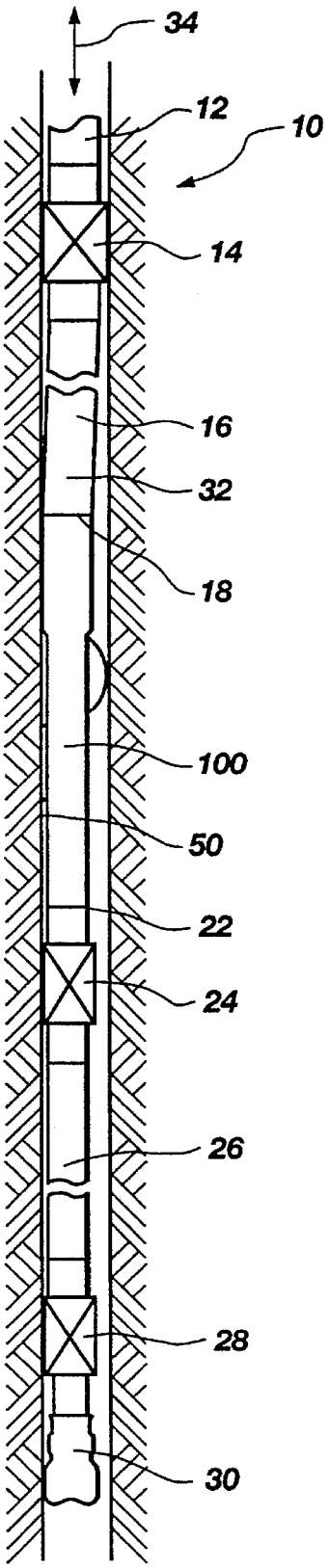
FIGS. 1 through 3 comprise schematic partial sectional elevations of a bottomhole assembly including a reamer wing as employed in one aspect of the present invention, the bottomhole assembly being shown in pass through condition (FIG. 1), in start up condition (FIG. 2) and in a normal drilling mode for enlarging the borehole (FIG. 3)

Commencing with FIG. 1 and moving from the top to the bottom of the assembly 10, one or more drill collars 12 are suspended from the distal end of a drill string extending to the rig floor at the surface. Pass through stabilizer (optional) 14 is secured to drill collar 12, stabilizer 14 being sized equal to or slightly smaller than the pass through diameter of the bottomhole assembly 10, Which may be defined as the smallest diameter borehole through which the assembly may move longitudinally. Another drill collar 16 (or other drill string element such as an MWD tool housing or pony collar) is secured to the bottom of stabilizer 14, below which reamer wing 100 according to the present invention is secured via tool joint 18, which may be a 6 ⅝ inch API joint. Another API joint 22, for example a 4 ½ inch API joint, is located at the bottom of the reamer wing 100. Upper pilot stabilizer 24, secured to reamer wing 100, is of an O.D. equal to or slightly smaller than that of the pilot bit 30 at the bottom of the assembly 10. Yet another, smaller diameter drill collar 26 is secured to the lower end of pilot stabilizer 24, followed by a lower pilot stabilizer 28 to which is secured pilot bit 30. Pilot bit 30 may be either a rotary drag bit or a tri-cone, so-called "rock bit". The bottomhole assembly as described is exemplary only, it being appreciated by those of ordinary skill in the art that many other assemblies and variations may be employed.

It should be noted that there is an upper lateral displacement 32 between the axis of pass through stabilizer 14 and that of reamer wing 100, which displacement is provided by the presence of drill collar 16 therebetween and which promotes passage of the assembly 10, and particularly the reamer wing 100, through a borehole segment of the design pass through diameter.

For purposes of discussion, the following exemplary dimensions may be helpful in understanding the relative sizing of the components of the assembly for a particular pass through diameter, pilot diameter and drill diameter. For a pass through diameter of 10.625 inches, a pilot diameter of 8.500 inches and a maximum drill diameter of 12.250 inches (the full bore diameter drilled by reamer wing 100) would normally be specified. In the bottomhole assembly 10, for the above parameters:

(a) drill collar 12 may be an eight inch drill collar;

(b) drill collar 16 may be a thirty foot, eight inch drill collar;

(c) drill collar 26 may be a fifteen foot, 6 ¾ inch drill collar; and (d) pilot bit 30 may be an 8 ½ inch bit.

In pass through condition, shown in FIG. 1, the assembly 10 is always in either tension or compression, depending upon the direction of travel, as shown by arrow 34 Contact of the assembly 10 with the borehole wall 50 is primarily through pass through stabilizer 14 and reamer wing 100. The assembly 10 is not normally rotated while in pass through condition.

Figure 2:
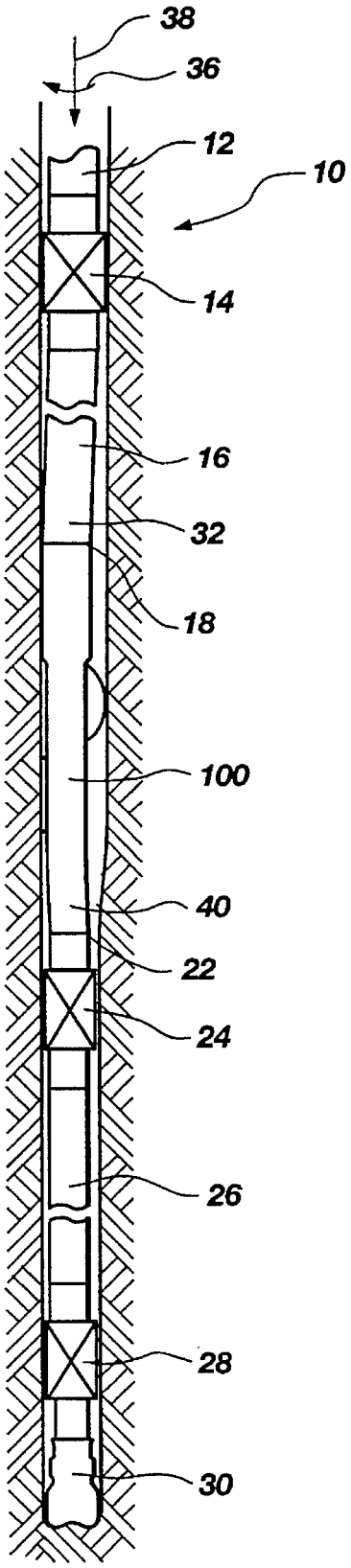

FIG. 2 depicts the start-up condition of assembly 10, wherein assembly 10 is rotated by application of torque as shown by arrow 36 as weight-on-bit (WOB) is also applied to the string, as shown by arrow 38. As shown, pilot bit 30 has drilled ahead into the uncut formation to a depth approximating the position of upper pilot stabilizer 24, but reamer wing 100 has yet to commence enlarging the borehole to drill diameter. As shown at 32 and at 40, the axis of reamer wing 100 is laterally displaced from those of both pass through stabilizer 14 and upper pilot stabilizer 24. In this condition, the reamer wing 100 has not yet begun its transition from being centered about a pass through center line to its drilling mode center line which is aligned with that of pilot bit 30.

Figure 3:
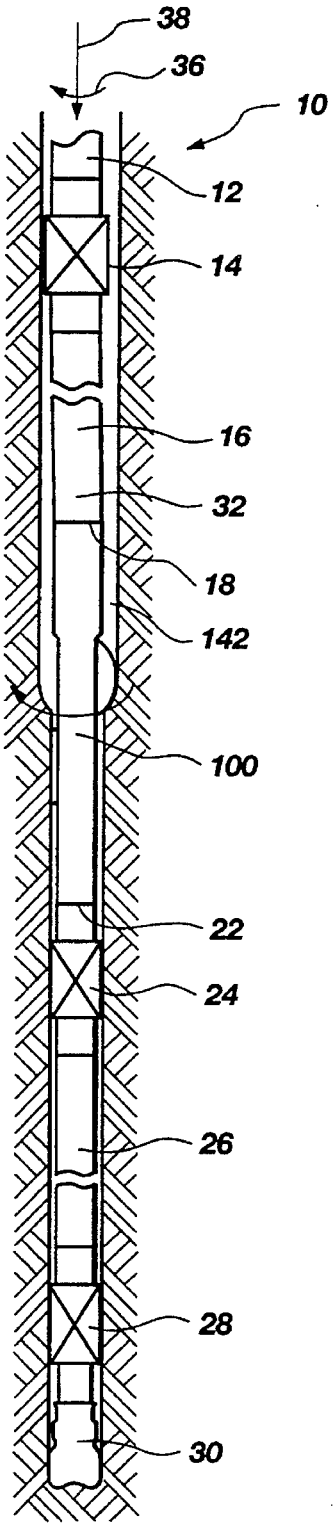

FIG. 3 depicts the normal drilling mode of bottomhole assembly 10, wherein torque 36 and WOB 38 are applied, and upper displacement 32 may remain as shown, but generally is eliminated under all but the most severe drilling conditions. Lower displacement 40 has been eliminated as reamer wing 100 is rotating about the same axis as pilot bit 30 in cutting the borehole to full drill diameter.

It may be seen that once normally drilling mode is reached, drilling proceeds, as far as the reamer wing blades are concerned, as with a normal drill bit. Thus, in this steady-state condition, it is desirable to equalize the work done by each of the blades by modifying the distribution of the depth of cut of the cutting elements on the various blades. Startup and transitional loading between start-up condition and normal drilling mode will always be complex and non-steady state, but the equalization of cutting loads among the blades according to the present invention will also better accommodate such transitional loading in a superior manner to state-of-the-art designs.

Figure 4:
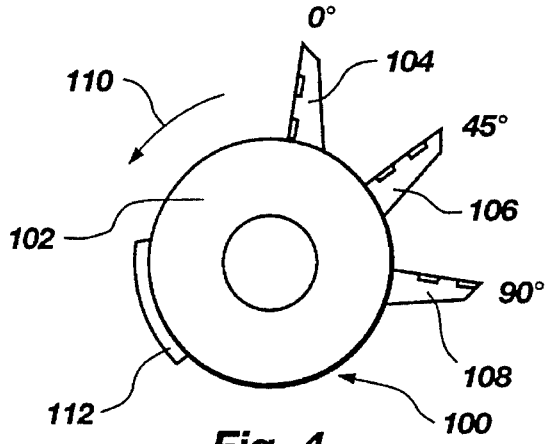
FIG. 4 is a schematic bottom elevation of a three-blade reamer wing with blades set at the 0°, 45° and 90° circumferential positions.

FIG. 4 is a schematic bottom elevation of an exemplary reamer wing 100 in accordance with the present invention including a tubular body 102 and three circumferentially-spaced blades 104, 106 and 108, looking upward from the bottom of the borehole. Blades 104, 106 and 108 would normally have the same or similar profile from reamer body 102 to the gage, or at least over a radial distance in which all would cooperatively cut with overlapping cutting element paths.

Blade 104, which is designated the "leading" blade with respect to the direction of rotation 110, may be said for the sake of convenience to be located at the 0° position of the 360° body circumference. Blade 104 would generally carry the radially innermost cutting element of all the blades, commonly designated the #1 cutter. Blades 106 and 108 are, respectively, set at the 45° and 90° positions, rotationally "behind" blade 104. Blade 106 would carry the #2 cutter, located at a slightly larger radius than cutter #1, while blade 108 would carry the #3 cutter, set at yet a slightly larger radius. Blade 104 would carry the #4 cutter (again a "leading" cutter), at a slightly larger radius than the #3 cutter on blade 108, and the sequence continued at least until gage diameter for the reamer wing 100 is reached. Such a spacing and cutter sequence would not be uncommon for the primary blades of a reamer wing.

On the opposite side of body 102 from blades 104, 106 and 108 and below the blades is an optional stabilizing pad 112 on the side of body 102 toward which the resultant lateral force vector of blades 104, 106 and 108 is directed during a reaming or hole-opening operation.

It is known that premature wear and damage of a reamer wing (and cutting elements) is not of substantial significance in softer formations wherein a high ROP such as 200–250 feet/hour is achievable. However, in harder formations where ROP may be at, for example, 30–120 feet/hour, premature wear and damage, particularly to PDC cutting elements and to cutting elements on a leading blade, may be significant.

In order to properly adjust the positions of the cutting; elements on the blades of reamer wing 100 to minimize adverse effects from the unequal spacing of blades 104, 106 and 108, it is desirable to select a realistic design ROP and a design rotational speed for the reamer wing to ascertain the depth of penetration of the formation per revolution. In this example, we select a 100 foot/hour ROP and a 120 revolution per minute rotational speed. Dividing 100 feet/hour by 120 revolutions per minute and correcting for units, we calculate the penetration per revolution as follows:

$$\frac{100\text{ feet/hr}}{120\text{ rev/min.}} \times \frac{1\text{ hr.}}{60\text{ min.}} \times \frac{12\text{ in.}}{\text{ft.}} = .167\text{ in/rev.}$$

Therefore, reamer wing 100 will penetrate the formation in question at approximately 0.167 in/rev.

Of the 0.167 in/rev. of penetration, given substantially identical cutting element locations, with respect to the blade profiles or with respect to an "exposure curve" on which lie the cutting edges of the cutting elements so that cutting element outer cutting edges are aligned on each of blades 104, 106 and 108, blade 104 will cut three-quarters of the penetration of 0.167 inches per each revolution, while blades 106 and 108 will each only cut one-eighth of the penetration. This is due to the fact that blade 104 cuts 270° of the 360° per revolution, or three-quarters of the penetration per revolution, while blades 106 and 108 cut a mere 45°, or one-eighth each, of the penetration per revolution. Given this observation, it is possible to adjust all of the cutting elements on a given blade "upward" or "downward" by the same distance with respect to the blade (or to adjust blade location itself) so that cutting elements on a trailing blade or blades take a relatively deeper cut into the formation and the leading blade cutting elements take a relatively shallower cut.

While cutting elements at the bottom of the blade may be adjusted in the "Z" direction or longitudinally, as one progresses up the side or flank of the blade away from body 102, an adjustment perpendicular to the blade profile is not necessarily a longitudinal adjustment, and so more generalized terminology has been employed.

It will also be appreciated that, rather than adjusting cutting element position, relative longitudinal blade position of the blades may be more easily altered to adjust cutting edge location, and that the lateral extent of the blade can be designed, along with longitudinal blade position, to provide the desired cutting element locations on one blade relative to those on another.

It will be appreciated that the leading cutting elements, those on blade 104, will be cutting a larger volume of formation material per revolution for identical cutter positions than those on blades 106 and 108. Therefore, by relatively "raising" the cutting elements on blade 104 to reduce their engagement with the formation, or "lowering" the cutting elements on blades 106 and 108 to increase their engagement depth, the volume of formation material cut by the cutting elements of blades 104, 106 and 108 can be substantially equalized. Given a rate of penetration per revolution of 0.167 inches, it can readily be seen that an "upward" movement of cutter #1 of 0.070 in. in combination with an "upward" movement of cutter #2 of 0.034 in. (cutter #3 remaining in its original design position) would balance the cutting action to substantially equalize cutter #1 's depth of cut with those of cutters #2 and #3 on the other two blades. Of course, the penetration per revolution would remain at. 0.167 in/rev., but the cutting work would be more equally balanced among the three cutters in question. The same design methodology can be applied to a second cutter sequence, and a third and additional, until gage diameter for the reamed borehole is reached. If all cutter sequences have started with the same relative cutter positions, the results from the first calculations can, of course, be applied to all of the sequences.

Figure 5:
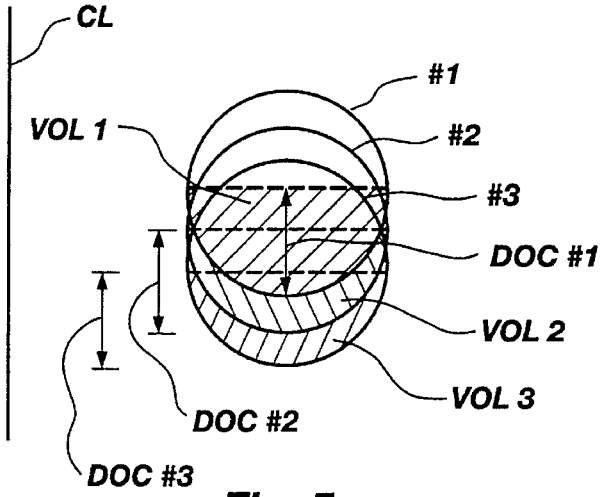
FIG. 5 is a schematic depicting a cutter sequence for the three blades of the reamer wing of FIG. 4, with the cutters superimposed as if they were located at the same radius.

Referring to FIG. 5 of the drawings, the preceding explanation of relative cutting element position and its effect on work performed is illustrated in simplistic terms. FIG. 5 depicts cutters #1, #2 and #3 as they would be placed on blades 104, 106 and 108 but on the same radial position relative to a centerline CL. Showing a depth of cut (DOC) with respect to cutter #1, and assuming the same DOC for cutter #2 and cutter #3, it can readily be seen that cutter #1 cuts a far greater volume of formation material and is thus more susceptible to wear and damage than cutter #2 or cutter #3. Stated another way, cutter #1 removes formation material over the full DOC, while cutters #2 and #3 only remove formation material over their swaths or rotational paths to the extent it has not already been removed by cutter #1, due to the overlaps of the circular cutter paths as the reamer wing rotates.

Thus, while cutter #1 removes a half-circular cross-sectional path VOL 1 of formation material, cutter #2 and cutter #3 remove only a far smaller arcuate path, designated respectively as VOL 2 and VOL 3 on FIG. 5. The next cutter sequence, cutters #4, #5 and #6, repeats this pattern, with cutter #4 taking a disproportionate volume of cut.

Since, in reality, cutters #1–#3 are radially spaced and not on the same radius, the degree of overlaps is somewhat reduced but has nonetheless proven quite significant to relative cutting element wear and damage between blades.

Figure 6:
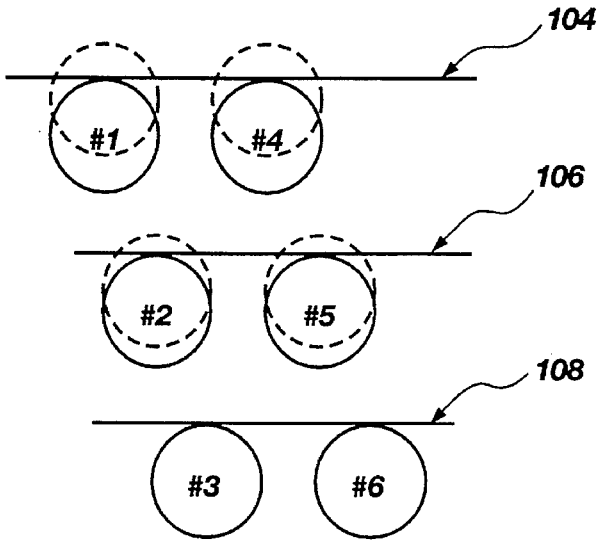
FIG. 6 is a schematic showing partial profiles of the three blades of the reamer wing of FIG. 4 with identical cutter locations as in the prior art and exaggerated adjustments to cutter locations in accordance with the present invention.

FIG. 6 illustrates a blade edge segment for each of blades 104, 106 and 108 of reamer wing 100 placed one above the other and depicting cutters #1, #2, #3, #4, #5 and #6 as those six cutters might normally be spaced and placed on the blade edges if the blade provide were straight or flat. Also shown in broken lines are the same cutters adjusted in position to modify the depth of cut and substantially equalize the cutting work performed on the formation by three blades spaced as with reamer wing 100 of FIG. 4. While the figure and degree of movement is not to scale, it will be seen that the cutters of blade 104 are moved upward or inward with respect to their original positions, roughly twice the distance that the cutters of blade 106 are moved in the same direction. The cutters of blade 108 remain in the same location.

This same methodology may be employed to vary cutter location relative to profile in standard drill bits, and particularly those bits having blades with substantial inequalities in circumferential blade spacing, such as anti-whirl bits.

It is also contemplated that a reamer wing may be designed in accordance with the present invention to over-accommodate the design ROP. For example, one might design to an ROP of 150 feet/hour (creating a steeper helix angle) to provide extra protection while drilling through adjacent hard and soft formations or softer formations with stringers, wherein ROP might suddenly drop from 250 feet/hour to 100 feet/hour, so that the leading blade and cutters might better address this abrupt transition without damage.

While the invention has been described in terms of a preferred embodiment, it is not so limited, and many other additions, deletions and modifications may be effected thereto without departing from the scope of the invention as hereinafter claimed.

What is claimed is:

1. An apparatus for enlarging a borehole in a subterranean formation, comprising:

a tubular, longitudinally-extending body adapted for rotation about a longitudinal axis therethrough;

a plurality of longitudinally-extending, circumferentially-spaced, generally radially-extending blades, each having a profile on the exterior thereof between said body and a gage diameter deemed by at least one of said blades;

at least one cutting element on the profile of one of said blades located with respect to at least one other cutting element on the profile of another of said blades in overlapping lateral relationship thereto as said body is rotated;

said at least one cutting element on said one of said blades being located with respect to said at least one other cutting element on said another of said blades so as to result in a cutting depth of said at least one cutting element which differs from that of said at least one other cutting element.

2. The apparatus of claim 1, wherein said plurality of blades are unequally circumferentially spaced about said body.

3. The apparatus of claim 2, wherein the circumferential spacing of said plurality of blades is such that said at least one cutting element on said one of said plurality of blades would, without said differing depth of cut, cut a different volume of formation material than said at least one other cutting element on said another of said blades, and said at least one cutting element is located to reduce its cutting depth relative to said at least one other cutting element to reduce said volume cut by said at least one cutting element.

4. The apparatus of claim 1, wherein said blades each carry a plurality of cutting elements on their profiles, at least some of which cutting elements are each radially located in rotational overlapping relationship with at least one other cutting element on another blade.

5. The apparatus of claim 4, wherein the circumferential spacing of said plurality of blades is such that said cutting elements on said one of said plurality of blades would, absent a different cutting depth, cut a different volume of formation material than said cutting elements on said another of said blades, and said cutting elements on said at least one blade are located to reduce their cutting depth relative to said cutting elements on said another blade to reduce said volume cut by said cutting elements on said at least one blade.

6. The apparatus of claim 5, wherein said plurality of blades comprises at least three blades, each carrying a plurality of cutting elements, and the cutting depth of said cutting elements carried by each of said blades is set to substantially equalize the distribution of volume of formation material cut among all of said blades over a radial range and by all of said blades.

7. The apparatus of claim 6, wherein said cutting element depths of cut are set as a group, or on a blade-by-blade basis.

8. The apparatus of claim 6, wherein said cutting element depths of cut are set individually for each cutting element.

9. A method of modifying the depth of cut of at least two radially adjacent cutting elements which cut rotational paths which laterally overlap, said at least two cutting elements being set at different circumferentially-spaced positions on a subterranean formation boring tool, the method comprising: determining the relative circumferential positions of said at least two cutting elements;

and setting one of said at least two cutting elements at a depth of cut which substantially equalizes the volume of formation material cut by each of said at least two cutting elements.

10. The method of claim 9, wherein said boring tool includes a plurality of blades and each of said at least two cutting elements is on a different blade at a different circumferential location.

11. The method of claim 10, wherein said at least two cutting elements comprise a plurality of cutting elements on each of said plurality of blades, and the cutting elements on one of said blades are set a depth which substantially equalizes the volume of formation material cut by the cutting elements on each of said blades to that cut by the others of said plurality of blades over a radial range of formation material cut by all of the blades of said plurality.

12. An apparatus for boring a subterranean formation, comprising:

a body including means at the upper extent thereof for securing said apparatus to a drill string; and a plurality of generally radially-extending, unequally circumferentially-spaced blades, each blade carrying at least one cutting element thereon which is positioned to cut a rotational path laterally overlapping the path of a cutting element on at least one other blade;

said at least one cutting element on a blade of said plurality being set to a depth of cut relative to that of said at least one other cutting element which substantially equalizes the volume of formation material cut by each cutting element.

13. The apparatus of claim 12, wherein each of said blades carries a plurality of cutting elements thereon, at least some of said plurality of cutting elements of each blade cutting paths which laterally overlap the paths of cutting elements on at least one other blade, and the cutting elements on one blade cutting such paths are set to depths of cut to substantially equalize the volume of formation material cut by those cutting elements with the volume of formation material cut by said cutting elements of said at least one other blade.

14. The apparatus of claim 13, wherein said depths of cut of a group of said cutting elements on a given blade are set to a common value.

15. The apparatus of claim 13, wherein the depths of cut of each cutting element on a given blade are set to different values.

* * * * *

UNITED STATES PATENT AND TRADEMARK OFFICE

CERTIFICATE OF CORRECTION

PATENT NO. : 5,495,899

DATED : March 5, 1996

INVENTOR(S) : Pastusek et al.

It is certified that error appears in the above-indentified patent and that said Letters Patent is hereby corrected as shown below:

In Column 1, line 38, delete the comma and period before "such";

In Column 1, line 42, change "reatner" to --reamer--;

In Column 2, line 40, change "deskable" to --desirable--;

In Column 2, line 49, change "whir" to --whirl--;

In Column 2, line 56, change "cuffing" to --cutting--;

In Column 3, line 22, change "Which" to --which--;

In Column 3, line 66, insert a period after "34";

In Column 5, line 7, delete the semicolon after "cutting"

In Column 6, line 4, delete the period after "at"

In Column 6, line 42, change "provide" to --profile--; and

In Column 7, line 12, change "deemed" to --defined--.

Signed and Sealed this

Thirtieth Day of July, 1996

*Attest:*

Bruce Lehman

BRUCE LEHMAN

*Attesting Officer*

*Commissioner of Patents and Trademarks*